United States Patent [19]

Zeller et al.

[11] Patent Number: 4,940,959

[45] Date of Patent: Jul. 10, 1990

[54] REVERSIBLE RESISTANT DEVICE

[75] Inventors: Claude Zeller, Monroe; Henry A. Mayeski, Norwalk; Charles F. Murphy, III, Fairfield, all of Conn.

[73] Assignee: Pitney Bowes, Inc., Stamford, Conn.

[21] Appl. No.: 388,742

[22] Filed: Aug. 3, 1989

Related U.S. Application Data

[63] Continuation of Ser. No. 71,237, Jul. 9, 1987, abandoned.

[51] Int. Cl.[5] ..... H01C 7/00

[52] U.S. Cl. ..... 338/13; 338/114; 338/215; 338/99; 338/308

[58] Field of Search ..... 338/215, 21, 308, 314, 338/13, 20, 99, 114

[56] References Cited

U.S. PATENT DOCUMENTS

| | | | |
|---|---|---|---|
| 4,041,436 | 8/1977 | Kouchich et al. | 338/20 X |
| 4,295,699 | 10/1981 | DuRocher | 338/99 X |
| 4,380,749 | 4/1983 | Eichelberger et al. | 338/215 |
| 4,729,809 | 3/1988 | Dery et al. | 338/13 X |

OTHER PUBLICATIONS

P. O. Sliva, G. Dir and C. Griffiths, "Bistable Switching and Memory Devices", 1970, pp. 316–333.

Earl L. Cook, "Model for the Resistive-Conductive Transition in Reversible Resistance-Switching Solids", Feb. 1970, pp. 551–554.

*Primary Examiner*—Bruce A. Reynolds

*Assistant Examiner*—Marvin M. Lateef

*Attorney, Agent, or Firm*—Peter Vrahotes; Melvin J. Scolnick; David E. Pitchenik

[57] ABSTRACT

A reversible resistant device having the property of being normally non-conductive, but being adapted to being converted to the conductive state. This change in conductive state is achieved by subjecting the device to a high voltage or high electric field. The essence of the device is a normally non-conductive film located between conductive layers, the film being formed by metal oxide coated metal particles embedded in a binder. When subjected to a high a potential, the metal oxide coating loses its dielectric properties and renders the film conductive.

5 Claims, 1 Drawing Sheet

REVERSIBLE RESISTANT DEVICE

This is a continuation of Ser. No. 071,237, filed 7/9/87, now abandoned.

BACKGROUND OF THE INVENTION

Recent literature has discussed a device that is normally non-conductive, but under certain conditions can be rendered conductive. These are referred to in various terms such as bi-stable switching and memory devices by Sliva, Dir and Griffiths of the Physics Research Labs, Xerox Corporation, in an article in the Journal of Non-Crystalline Solids, 1970; Reversible Resistance-Switching Solids, as described by Earl L. Cook of Central Research Labs, 3M Company, in Vol. 41, No. 2, Journal of Applied Physics, February, 1970. For the purpose of the following description, these devices will be referred to as "reversible resistant devices". Such devices have the property that they are normally non-conductive, but upon being exposed to a physical phenomenon they are rendered conductive. The physical phenomenon may be high voltage, a high electric field or any other force that would tend to break down a dielectric component of the device.

Although reversible resistant devices have been known in the past, to date there has been no widespread commercial use of the same. This is believed to be because the reliability of such devices has not been high.

BRIEF DESCRIPTION OF THE INVENTION

A reversible resistance device has been conceived wherein a normally non-conductive film is placed between two conductive layers. Initially, the film is a dielectric or insulator with high resistivity, but when exposed to certain conditions, it will assume the properties of a conductor. The normally non-conductive film includes metal particles coated with a metal oxide metal layer, the coated particles being received within a suitable binder to form a dielectric layer. This dielectric layer is applied to the surface of a conductor and a second film is disposed upon the first film. The second film includes conductive particles being impregnated in a high concentration within a binder so that the second film is conductive. Another conductive surface comes into contact with the second film. In this state, the first film prevents current from flowing from the first conductive surface to the second conductive surface. When exposed to a high voltage, the metal particles are heated and the dielectric strength of the oxide metal coated particles will experience dielectric loss rendering the particles conductive. The metal particles will then flow into contact with the first surface and the second film to bring about an electrical connection between the two conductive surfaces.

DETAILED DESCRIPTION OF THE PREFERRED EMBODIMENT

Figure 1:
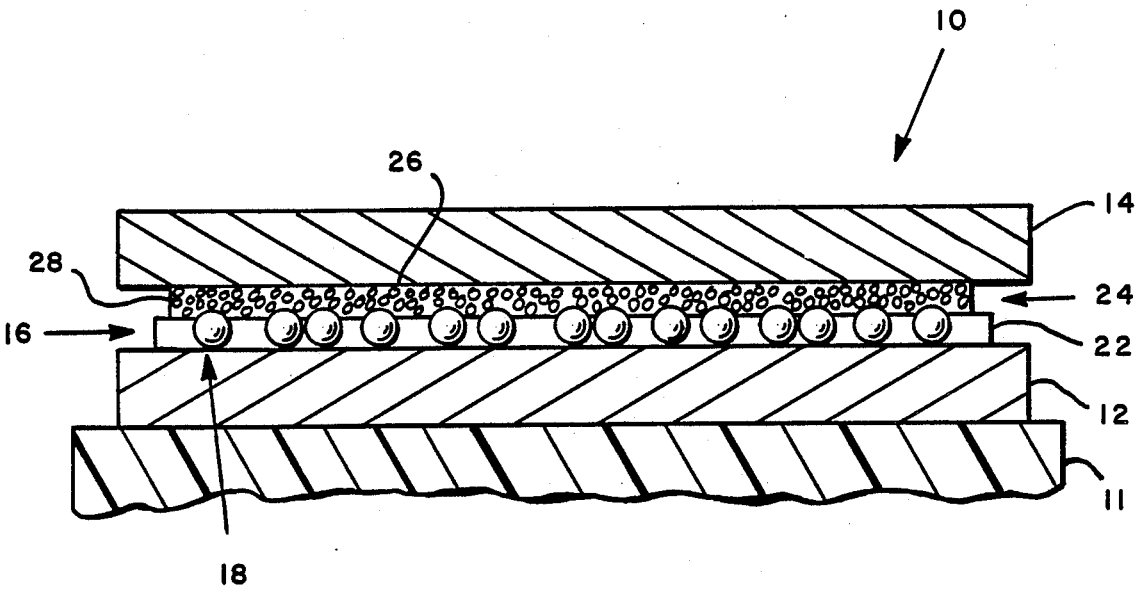
FIG. 1 is a longitudinal view of a reversible resistance device that incorporates features of the instant invention.
Figure 2:
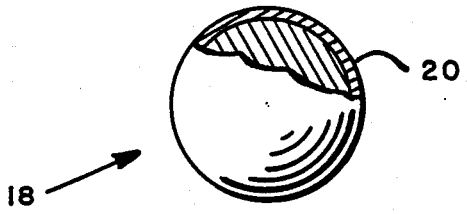
FIG. 2 is a partially cross sectional view of a metal particle shown in FIG. 1.

With reference to FIGS. 1 and 2, a reversible resistance device is shown generally at 10 that is supported on a substrate 11. The reversible resistance device 10 includes first and second conductive layers 12 and 14, respectively. The first conductive layer 12 is disposed upon the substrate 11. Normally these two conductive layers 12,14 would be part of another device, apparatus or circuit and the like for which temporary electrical isolation is desired. An example of such a device would be a radio frequency (RF) electronic article surveillance (EAS) tag and the two conductive surfaces 12 and 14 would represent turns of a copper coil and the substrate 11 would represent a paper or plastic outer cover. Although not shown, in an RF EAS tag the upper conductive layer would also have a plastic or paper cover thereover. The use of the reversible resistant device 10 with such an EAS device will be explained hereinafter.

Applied to the surface of the first conductive layer 12 is a normally non-conductive film 16. This film 16 includes a plurality of particles 18 having an inner metallic portion 19 with a metal oxide coating 20 thereover. The particles 18 are embedded within a binder 22 with the particles protruding slightly beyond the binder 22. Applied to the top of this first film 16 is a second film 24 composed of metal flakes 26 in high concentration received within a binder 28. This second conductive film 24 is in intimate contact with the conductive surface 14 and receives the exposed portions of the metal particles 18.

The break-down film 16 is includes particles 18 having a metallic portion 19 coated with a non-conductive material 20. Examples of such particles are aluminum coated with aluminum oxide and copper coated with stearic acid. Aluminum has characteristics that lends itself well to this application. The coating of aluminum oxide is generally uniform and relatively chemically inert. Such materials are commercially available from Aluminum Company of America and identified as Alcoa aluminum powder 1401 and from Aluminum Company of Canada and identified as Alcan aluminum powder X-81. Such particles 18 are added to a binder 22 such as nitrocellulose lacquer to form a smooth metallic dispersion. The particles normally have a diameter of approximately 5–25 microns and the oxide coating thereover will be approximately 50 angstroms thick. When subjected to a relatively high voltage or electromagnetic field, the oxide coating 20 will experience a dielectric loss which will cause voltage breakthrough and the metallic portion 19 of the particles 18 will then become soft and fuse with the conductive film 24 and the conductive layer 12. When this occurs, the first film 16 becomes conductive. It has been determined experimentally that the fusion resulting from exposure to a high energy field and subsequent dielectric loss is more extensive and stronger with aluminum particles when compared to using coated copper particles under the same circumstances. The voltage required to bring about dielectric loss is determined by the thickness and dielectric strength of the oxide coating 20.

Preferably, the first film 16 is one particle layer deep in terms of metal particles 18. This has been found more effective in shorting the film 16 when exposed to a high voltage or electromagnetic field since only one coating (two layers) of oxide needs to be overcome. Having the particles 18 extend slightly into the conductive film 24 also aids in shorting of the device 10. If the binder 22 completely covered the coated metal particles 18 a higher voltage would be required for shorting because the binder 22 material between the particles 18 and the film 24 would have to be overcome.

The conductive film 24 is preferably made of a polymer dispersed within a weak solvent of high volatility. By weak solvent is meant those solvents which are characterized as having a low or non-external polarization of molecules. In addition, it is preferable that the conductive film 24 be a dispersion of polymers as opposed to a solution. With this combination, it has been found that the solution of the conductive film 24 will not penetrate the binder 22 to bring about premature electrical connection between the two layers 12,14. Furthermore, being dispersed results in faster evaporation rates of the solvents. More specifically, diffusion between the layers is reduced, thus, minimizing the potential for premature shorting between the conductive layer 12 and the conductive film 24. The preferred conductive film 24 has a binder of acrylic dispersion within a solution of VMP naptha filled with 65% conductive material such as silver flakes. The acrylic binder slightly blends with the breakdown film 16 to provide adhesion, but does not fully penetrate the break-down film binder 22.

As stated previously, the particles 18 protrude slightly beyond the binder 22. It has been found that greater reliability is achieved through this expedience. Preferably, the particles 18 will protrude approximately 20% to 25% of their diameter beyond the binder 22 and be partially received within the conductive film 24.

Figure 3:
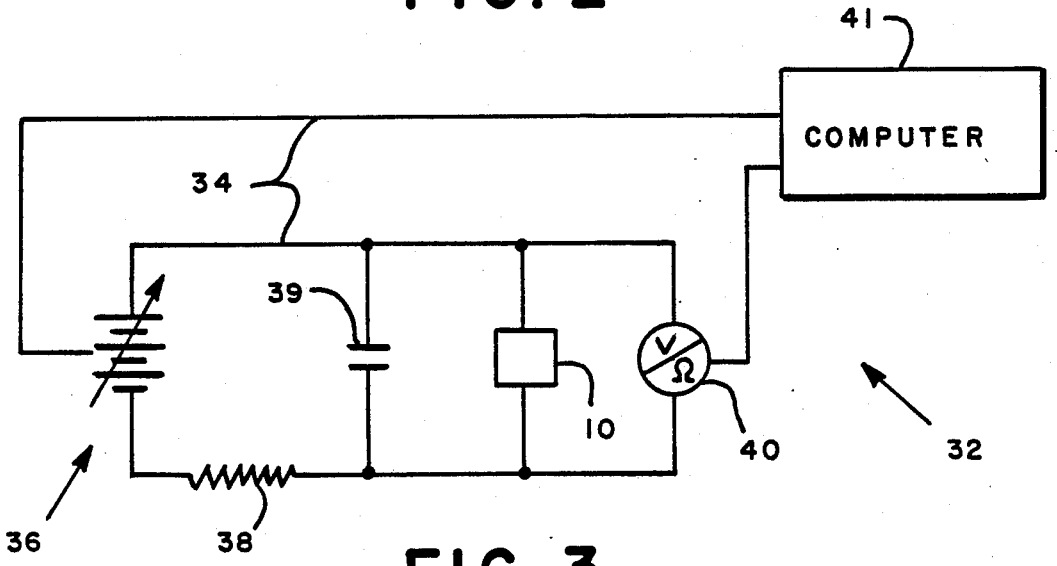
FIG. 3 is a circuit diagram of a circuit used to test the device shown in FIG. 1.

With reference to FIG. 3, after the reversible resistance device 10 has been fabricated it is placed within the circuit 32 as a component thereof for the purpose of determining the voltage required to short the device. This circuit 32 includes wiring 34 that connects the various components, a variable power supply 36, a resistor 38, a capacitor 39 and a volt-ohm meter 40, to form a closed loop. The reversible resistance device 10 is shunted into this loop between the capacitor 39 and the volt-ohm meter 40. A computer 41 is in electrical connection with the variable power supply 36 and the volt-ohm meter 40. With this circuit, one is able to make a determination of the voltage required to break-down the resistant film 16. More specifically, the device 10 was subjected to voltages in the range of 0–50 volts. Initially, the computer 41 directs the variable power supply to provide a relatively small voltage to the current, i.e., 5 volts. The computer 41 determines the initial resistance and voltage of the reversible resistance device 10. The computer 41 then causes the power supply to increase the voltage and then determines the voltage required to break-down the device 10 and measures the final resistance after break-down. Ideally, the device 10 will maintain its dielectric state when 0–3 volts is applied. A number of tests were conducted on the device 10 and it was found that the dielectric loss of the film 16 did reach the levels anticipated, i.e., in the range of 3–20 volts. It was found that the break down voltage may be controlled by varying the size of the particles 18 and the thickness of the oxide coating 20 thereover.

Although the test was conducted using voltage breakdown, it will be appreciated that the same applies when the reversible resistance device 10 is placed in an electromagnetic field. The dielectric strength of the device 10 is overcome by the induced potential generated in the device by the electromagnetic field so that a voltage is created and the switching results are achieved.

It will be appreciated that such a device 10 will be useful in many fields. As indicated previously, the device 10 may be used to create a deactivatible RF marker. The two surfaces 12 and 14 would represent two turns of a copper coil used in such a marker. Normally the two turns would be isolated from one another so that the marker would be responsive to an electromagnetic field to emit a responsive pulse. In order to deactivate the marker, the marker would be placed in a higher than normal electromagnetic field and the device 10 would be rendered conductive, thereby shorting out the coils 12,14. Other applications would include solid state devices and integrated circuits wherein it would be desirable to isolate two components under initial conditions, but eventually provide a connection therebetween. An example of this would be a write once memory.

EXAMPLE 1

| | Parts by Weight |
|---|---|
| Breakdown film | |
| Nitro cellulose lacquer | 30 |
| Aluminum (Alcoa 1401) | 1.2 |
| Mixing procedure: Add aluminum powder to nitro cellulose laquer with adequate stirring to effect a smooth metallic dispersion. | |
| Conductive film | |
| acryloid NAD-10 (40% in naptha) | 10 |
| silflake #237 metal powder | 20 |
| mixing procedure: Add metal powder to acrylic dispersion with stirring | |

The breakdown film 16 is first applied to the first conductive layer 12 by either spraying or painting. the spraying may be either air press spraying or electrostatic spraying. The painting may be either through flexographic or gravure printing. After the breakdown film 16 is applied to the conductive layer 12, it is dried either by remaining in air for a sufficient period or by oven drying. The conductive film 24 is applied to the breakdown film 16, again, either by spraying or printing and the second conductive layer 14 immediately applied thereto. The conductive film 24 is then dried to adhere both to the second conductive layer 14 and the breakdown film 16.

| | |
|---|---|
| Break-down film | |
| acryloid B-48N (45% in toluene) | 30 |
| Acetone | 20 |
| isopropanol | 3 |
| Above solution | 10 |
| Aluminum Powder (Alean x81) | 5 |
| Conductive film | |
| acryloid NAD-10 (40% in naptha) | 10 |
| silflake #237 metal powder | 20 |
| mixing procedure: Add metal powder to acrylic dispersion with stirring | |

The same procedures may be used to fabricate the reversible resistant device as described in Example 1.

We claim:

1. A reversible resistant device comprising:

a first conductive layer, a second conductive layer opposed relative to said first conductive layer, a normally non-conductive film disposed intermediate said first and second conductive layers, said normally non-conductive film comprising metal particles having a non-conductive coating thereover disposed within a first binder, and a conductive film located intermediate said normally non-conductive film and said second layer, said conductive film comprising metal particles dispersed within a second binder, said metal particles protruding from said first binder up to 25% of their diameter, whereby upon being exposed to an electrical force said non-conductive coating breaks down to render said normally non-conductive film conductive.

2. The device of claim 1 wherein said metal particles of said normally non-conductive layer are aluminum and said coating thereover is aluminum oxide.

3. The device of claim 2 wherein said second binder is a polymer dispersed in a weak binder.

4. A method of producing a reversible resistant device, the steps comprising:

producing a normally non-conductive film by dispersing within a first binder metal particles having thereover a non-conductive coating which has the property of breaking down when exposed to an electric force with up to 25% of the diameter of the metal particles protruding from the first binder, applying the normally non-conductive film to a first conductive layer, applying a conductive film comprising metal particles dispersed within a second binder to the normally non-conductive film and, placing a second conductive layer over said normally non-conductive film.

5. The method of claim 4 wherein said conductive film is formulated by dispersing conductive flakes in a dispersion of a polymer in a weak solvent.

* * * * *